United States Patent [19]

Honma et al.

[11] Patent Number: 4,918,902

[45] Date of Patent: Apr. 24, 1990

[54] METHOD OF AND APPARATUS FOR FILLING INERT GAS IN A CAN

[75] Inventors: Tohru Honma, Omiya; Shigeki Mori, Kuki; Kunihiko Ohya, Kasukabe; Shiro Matsumoto, Kasukabe; Akira Nakata, Ageo; Ichiro Abe, Yokohama; Naoto Hosaka, Kamakura, all of Japan

[73] Assignees: Hokkai Can Co., Ltd.; Kirin Brewery Co., Ltd., both of Tokyo, Japan

[21] Appl. No.: 225,838

[22] Filed: Jul. 29, 1988

[51] Int. Cl.[5] ..... B65B 31/04

[52] U.S. Cl. ..... 53/403; 53/432; 53/510

[58] Field of Search ..... 53/403, 426, 432, 510; 141/6, 5, 9, 105, 70; 426/486, 600, 592

[56] References Cited

U.S. PATENT DOCUMENTS 3,246,447 4/1966 Smith et al. .
3,545,160 12/1970 Jantze et al. ..... 53/403
4,312,171 1/1982 Vadas ..... 53/403
4,655,029 4/1987 Weiss ..... 53/403 X

FOREIGN PATENT DOCUMENTS 0214372 6/1986 European Pat. Off. .
1119700 12/1961 Fed. Rep. of Germany .
3000991 7/1981 Fed. Rep. of Germany .
3640693 6/1987 Fed. Rep. of Germany .

*Primary Examiner*—James F. Coan

[57] ABSTRACT

The lower edge of the peripheral wall of a can cap and the upper edge of a can barrel are spaced from each other by a gap therebetween. Streams of an inert gas from different groups of injector nozzles are injected, from outside of the gap, through the gap into the can cap and the can barrel, respectively, to replace air in the can cap and the can barrel with the injected gas. Then, the can barrel is fitted in to the can cap, and welded thereto to entrap the injected gas in the can barrel and the can cap.

20 Claims, 5 Drawing Sheets

METHOD OF AND APPARATUS FOR FILLING INERT GAS IN A CAN

BACKGROUND OF THE INVENTION

1. Field of the Invention:

The present invention relates to an method of and an apparatus for replacing air in a head space in a can which contains a carbonated beverage or the like, with an inert gas, and enclosing the inert gas in the head space.

2. Description of the Prior Art:

In the canning industry, it has been customary to replace air in a head space in a can with an inert gas such as a carbon dioxide gas, a nitrogen gas, or the like in a head space in a can, and enclose the inert gas in the head space in order to prevent the quality of preserved contents of the can from being lowered. According to one known method disclosed in Japanese Patent Publication No. 57-29331, an inert gas is injected into a head space in a can barrel filled with contents to replace air in the head space with the inert gas, and then a cap end is mounted on and fixed to the can barrel by seaming.

FIG. 5 of the accompanying drawings shows a can end or cap A having a circular panel a and a cylindrical peripheral wall b depending from the entire periphery of the panel a. The peripheral wall b is fitted over and soldered to an end of a cylindrical can barrel or body B which is filled with contents. If an inert gas is introduced into the can of FIG. 5 by a conventional inert gas filling apparatus, then it is necessary to replace the head space in the can barrel B and also an internal space in the can cap A with the inert gas. It takes a long period of time to replace both spaces with the inert gas even if the amount of the inert gas to be injected and the pressure under which the inert gas is to be injected are carefully controlled. Moreover, the injected inert gas tends to fail to reach every corner of the can cap A and the can barrel B.

SUMMARY OF THE INVENTION

In view of the aforesaid drawbacks of the conventional method and apparatus for filling an inert gas in a can, it is an object of the present invention to provide a method of and an apparatus for replacing air in a head space in a can barrel and an internal space in a can cap with an inert gas in a highly efficient manner and also enclosing the inert gas in the can barrel and the can cap.

According to the present invention, there is provided a method of filling an inert gas in a cap including a can cap having a panel and a peripheral wall depending from the panel along the entire periphery of the panel and a can barrel filled with contents, the method comprising the steps of: spacing a distal edge of the peripheral wall of the can cap and a distal edge of the can barrel from each other by a gap therebetween; injecting streams of an inert gas from different groups of injector nozzles, from outside of the gap through the gap into the can cap and the can barrel, respectively, to replace air in the can cap and the can barrel with the injected gas; and fitting the can barrel into the can cap; and adhering the can barrel and the can cap to each other to entrap the injected gas therein.

According to the present invention, there is also provided an apparatus for filling an inert gas in a cap including a can cap having a panel and a peripheral wall depending from the panel along the entire periphery of the panel and a can barrel filled with contents, the apparatus comprising: can cap holder means for holding the can cap with the panel up; a can barrel lifting/lowering device for lifting the can barrel up to a first position in which an upper edge of the can barrel is spaced a gap from a lower edge of the peripheral wall of the can cap held by the can cap holder means, and then for lifting the can barrel up to a second position in which the upper edge of the can barrel is fitted into the peripheral wall of the can cap; and an inert gas injector having a plurality of injector nozzles along the gap for injecting an inert gas through the gap into the can cap and the can barrel to replace air in the can cap and the can barrel with the injected gas, when the can barrel is in the first position.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

FIGS. 1 through 4 show an apparatus according to the present invention.

Figure 5:
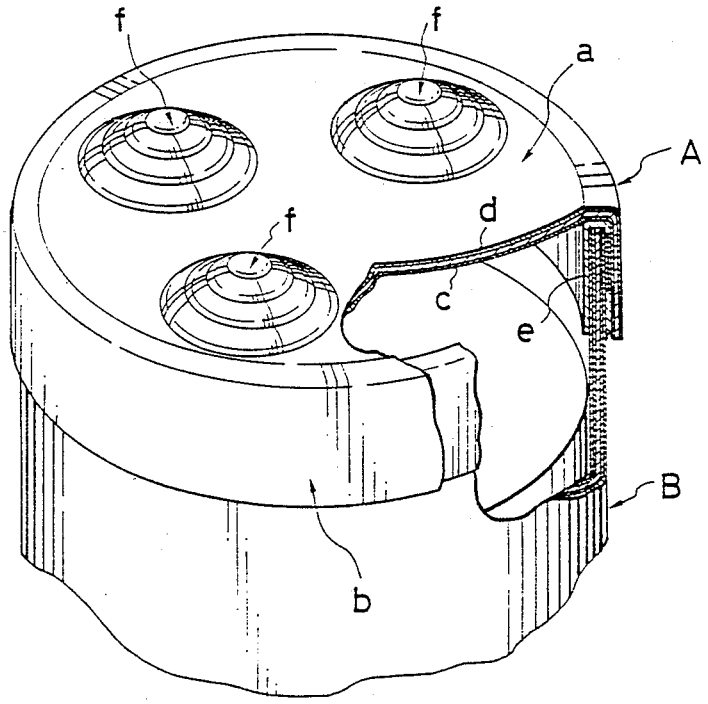
FIG. 5 is a fragmentary perspective view of a can cap and a can barrel which are to be employed in the apparatus of the invention.

The apparatus of the invention employs, as shown in FIG. 5, a can cap A made of a metallic foil d such as an aluminum foil having a thermally fusible synthetic resin layer c on its inner surface. A connector e of synthetic resin is mounted on the upper edge of a can barrel B.

Figure 1:
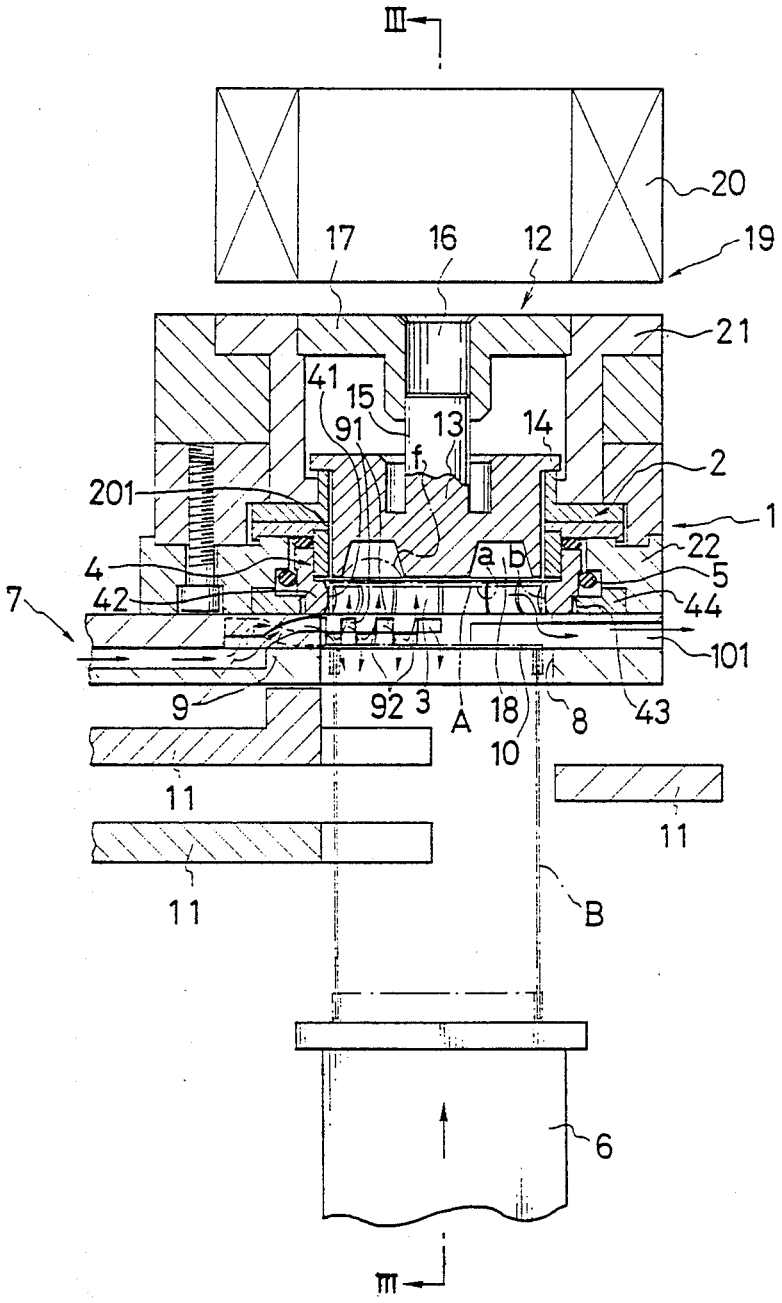
FIG. 1 is a vertical cross-sectional view of an apparatus according to the present invention, showing the manner in which an inert gas is charged.
Figure 2:
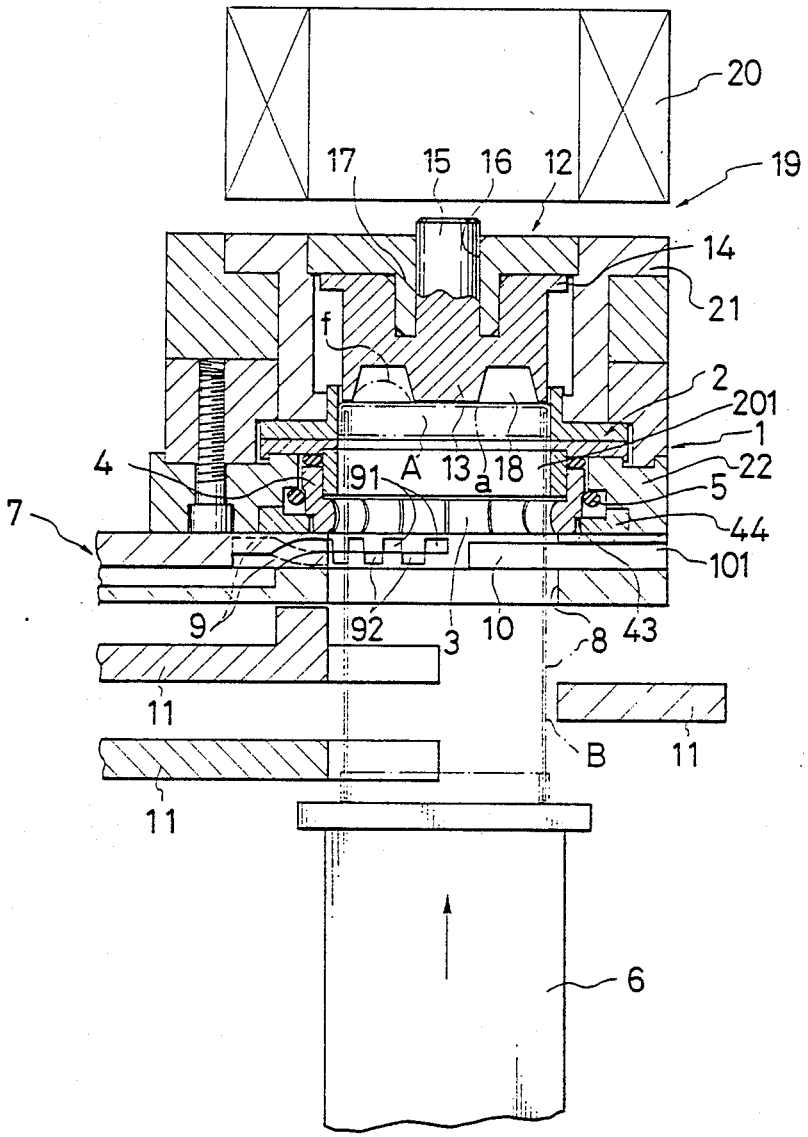
FIG. 2 is a view similar to FIG. 1, illustrating the manner in which a can barrel is fitted in a can cap.

As shown in FIG. 1, the apparatus of the invention includes a can cap holder 1 comprising a base tubular member 2 having a hollow tubular space 201 shaped complementary to the outer profile of the peripheral wall b of the can cap A, and a presser 4 having an opening 3 disposed concentrically and identical in shape to the hollow tubular space 201, in which opening 3 the peripheral wall b of the can cap A can be fitted. The presser 4 is circumferentially divided into a plurality of segments along the entire lower edge of the base tubular member 2. The presser 4 is resiliently urged radially inwardly toward the center of the opening 3 by a fastening ring 5 disposed around an upper outer surface thereof.

The presser 4 has on its lower inner surface a radially inwardly projecting land 42 having a curved surface 41 facing radially inwardly. The presser 4 also has an upper inner surface engaging the lower outer surface of the base tubular member 2, by which the presser 4 is prevented from being displaced radially inwardly. The presser 4 has on its lower outer surface a step 43 placed on a guide 44 disposed in a lower portion of a support 22 for allowing the presser 4 to be retracted radially outwardly against the bias of the fastening ring 5.

The apparatus also includes a can barrel lifting/ lowering device 6 for supporting the bottom of the can barrel B filled with contents and lifting the open upper edge of the can barrel B from a position below the can cap A held by the can cap holder 1 toward the lower edge of the peripheral wall b of the can cap A. The can barrel lifting/lowering device 6 can be vertically moved by a cam device (not shown). The can barrel lifting/lowering device is elevated by the cam device to lift the can barrel B up to a position in which the upper edge of the can barrel B is spaced a small gap from the lower surface of the peripheral wall b of the can cap A. Then, an inert gas is charged from an inert gas injector (described later) through the gap into an inner space in the can cap A and a head space in the can barrel B to replace air in these spaces with the introduced inert gas. Thereafter, the can barrel B is further lifted to fit the upper edge thereof into the peripheral wall b of the can cap A to close the can barrel B with the can cap A. Subsequently, the thermally fusible synthetic resin layer c on the inner surface of the peripheral wall b of the can cap A is welded to the outer surface of the upper edge of the can barrel B by a can cap welder (described later), after which the can barrel B and the can cap A as they are bonded are lowered.

The inert gas injector, generally designated at 7, has a tubular member 8 disposed below the opening 3 of the can cap holder 1 for insertion therethrough of an upper portion of the can barrel B. The inert gas injector 7 also includes a plurality of gas injector nozzles 9 defined in the tubular member 8 and opening at the circular inner peripheral surface thereof partly around the gap to be created between the upper edge of the can barrel B and the lower edge of the peripheral wall b of the can cap A. The inert gas injector nozzles 9 are grouped into a plurality of pairs of adjacent nozzles 9. One of nozzles 92 in each pair is oriented to inject the inert gas upwardly into the inner space in the can cap A held by the can cap holder 1, whereas the other nozzle 91 in each pair is directed to inject the inert gas downwardly into the head space in the can barrel B. Therefore, alternate streams of the inert gas are injected into the can cap A and the can barrel B. The injector nozzles 9 are disposed around substantially half of the entire circumference of the gap. The inner peripheral surface of the tubular member 8 has an inert gas discharge hole 10 defined therein in diametrically opposite relation to the injector nozzles 9 for discharging an excessive inert gas through a discharge passage 101.

A guide device 11 is disposed below the inert gas injector 7 for holding the can barrel B against being tumbled over when the can barrel B is lifted or lowered by the can barrel lifting/lowering device 6.

A can cap pressing device 12 disposed upwardly of the can cap holder 1 has a panel presser member 13 inserted in the base tubular member 2 above the presser 4 of the can cap holder 1. The panel presser member 13 has a flange 14 on its uppermost outer peripheral edge, the flange 14 being engageable with the upper edge of the base tubular member 2 to limit downward movement of the panel presser member 13. The panel presser member 13 also has a guide member 15 projecting upwardly therefrom and slidably inserted in a guide hole 16 defined in a limit member 17 above the panel presser member 13. Upward movement of the panel presser member 13 is limited when it is engaged by the limit member 17. The panel presser member 13 can be lowered by gravity. The panel presser member 13 has an annular recess 18 defined in the lower surface thereof for receiving legs f projecting on the can cap A shown in FIG. 5.

The can cap welder, generally denoted by 19, comprises a primary high-frequency induction coil 20 and a secondary high-frequency induction coil 21. The secondary high-frequency induction coil 21 is disposed substantially around the can cap pressing device 12, so that the induction coil 21 is positioned around the position in which the can barrel B lifted by the can barrel lifting/lowering device 6 is fitted into the peripheral wall b of the can cap A held by the can cap holder 1 after the inner space in the can cap A and the head space in the can barrel B are filled with the inert gas which has been charged via the gap between the can cap A and the can barrel B.

Operation of the apparatus will now be described below.

Figure 3:
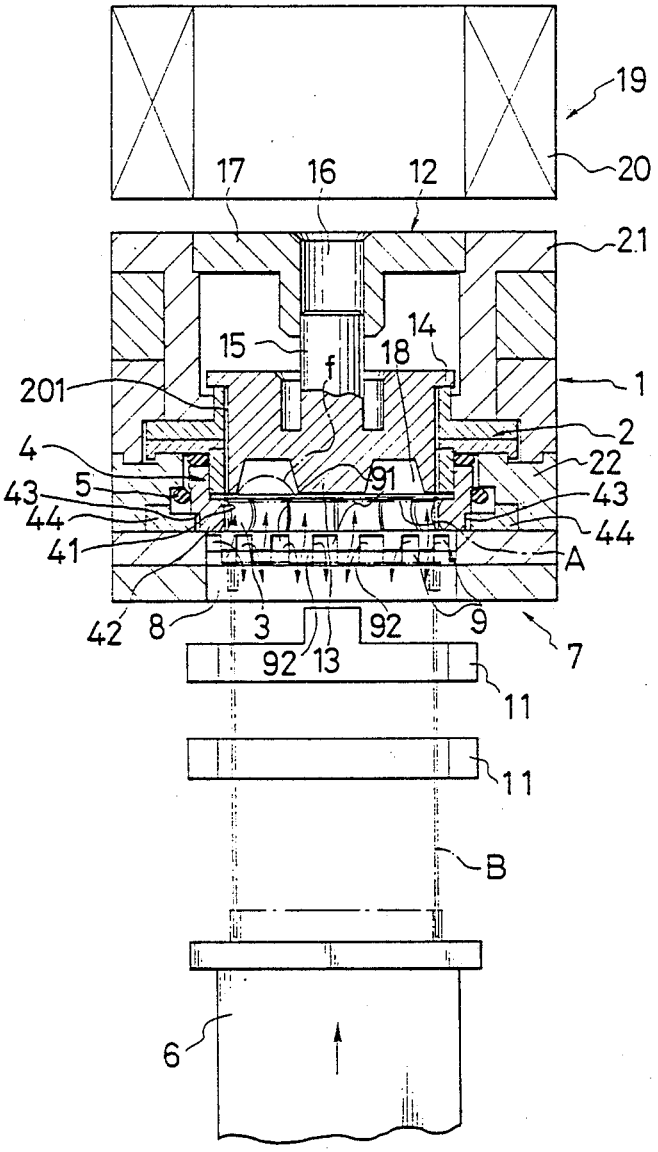
FIG. 3 is a cross-sectional view taken along line III—III of FIG. 1.
Figure 4:
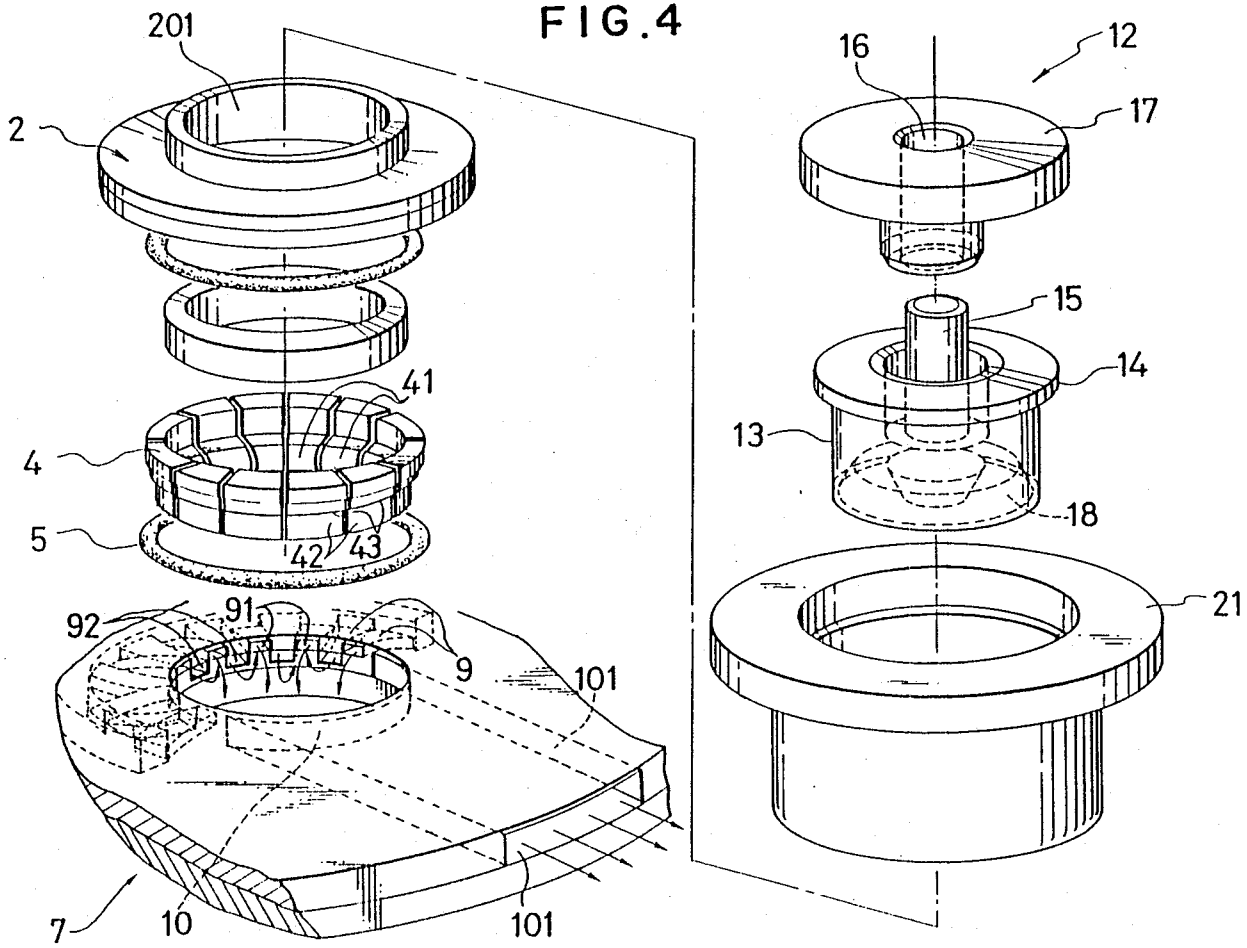
FIG. 4 is an exploded perspective view of a portion of the apparatus shown in FIG. 1.

As indicated by the imaginary lines in FIGS. 1 and 3, the can cap A is fitted in the opening 3 of the can cap holder 1 with the panel a up by a can cap lifter (not shown), and the outer surface of the peripheral wall b being pressed against the presser 4. Then, as illustrated in FIGS. 1 and 3, the can barrel B filled with contents is lifted toward the can cap A by the can barrel lifting/ lowering device 6 up to the position in which the upper edge of the can barrel B is spaced a small gap from the lower edge of the peripheral wall b of the can cap A. Thereafter, an inert gas is injected from the injector nozzles 92, 91 of the inert gas injector 7 through the gap between the can cap A and the can barrel B into the inner space in the can cap A and the head space in the can barrel B to replace air in these spaces with the charged inert gas.

Since streams of the inert gas from the injector nozzles 92, 91 are directed at different angles into the internal space in the can cap A and the head space in the can barrel B, the inert gas can be introduced into every corner of the spaces in the can cap A and the can barrel B, while forcing any air out of the spaces through the gap. The charged inert gas is filled and remains in the spaces in the can cap A and the can barrel B, thus efficiently replacing the air in these spaces.

After the air in the can cap A and the can barrel B has been replaced with the introduced gas, the can barrel B is further elevated by the can barrel lifting/lowering device 6 so as to fit into the peripheral wall b of the can cap A with its panel a pressed down by the panel presser member 13 of the can cap pressing device 12. The can barrel B is continuously caused to ascend with the can cap A while being guided by the base tubular member 2 until the panel presser member 13 reaches its uppermost position shown in FIG. 2, in which the can barrel B is fully fitted into the can cap A.

Then, the primary high-frequency induction coil 20 of the can cap welder 19 is energized to enable the secondary high-frequency induction coil 21 positioned in radially confronting relation to the peripheral wall b of the can cap A to induction-heat the metallic foil d on the can cap A for thereby fusing the thermally fusible synthetic resin layer c to the can barrel B.

Thereafter, the can barrel lifting/lowering device 6 is lowered to allow the panel presser member 13 to descent by gravity. The can barrel B sealed by the can cap A is pressed downwardly by the panel presser member 13 and removed from the can cap holder 1.

With the present invention, as described above, the can cap is held by the can cap holder with the panel thereof up, and the can barrel filled with contents is lifted, from below, toward the can cap by the can barrel lifting/lowering device up to the position in which the lower edge of the peripheral wall of the can cap and the open upper edge of the can barrel are spaced the small gap from each other. Then, the inert gas is injected from the injector nozzles through the small gap into the inner space in the can cap and the head space in the can barrel. Therefore, the inert gas can reach every corner of these spaces, forcing any remaining gas out of the spaces through the small gap. The inert gas can remain in the spaces. Thus, the charged inert gas can efficiently replace the air in the spaces. The can barrel is continuously elevated by the can barrel lifting/lowering device so that the can barrel is immediately fitted into the can cap after the inert gas has been injected. Consequently, the injected gas can reliably be entrapped or enclosed in the can barrel and the can cap which are assembled together.

Although a certain preferred embodiment has been shown and described, it should be understood that many changes and modifications may be made therein without departing from the scope of the appended claims.

What is claimed is:

1. An apparatus for filling an inert gas in a cap including a can cap having a panel and a peripheral wall depending from the panel along the entire periphery of the panel and a can barrel filled with contents, said apparatus comprising:

can cap holder means for holding the can cap with the panel up;

a can barrel lifting/lowering device for lifting the can barrel up to a first position in which an upper edge of the can barrel is spaced a gap from a lower edge of the peripheral wall of the can cap held by said can cap holder means, and then for lifting the can barrel up to a second position in which the upper edge of the can barrel is fitted into the peripheral wall of the can cap; and an inert gas injector having a plurality of injector nozzles along said gap for injecting an inert gas through said gap into said can cap and said can barrel to replace air in said can cap and said can barrel with the injected gas, when said can barrel is in said first position, said inert gas injector includes an inert gas discharge passage disposed in opposite relation to said injector nozzles for discharging an excessive inert gas injected from said injector nozzles and discharged through said can barrel and said can cap.

2. The apparatus according to claim 1, wherein said can cap holder means comprises a presser for resiliently holding the peripheral wall of the can cap radially inwardly, a base tubular member concentric with said presser for guiding upward movement of said can cap therein, sand a vertically movable presser member slidably disposed in said base tubular member for limiting upward movement of the panel of the can cap in said base tubular member.

3. The apparatus according to claim 1, wherein the peripheral wall of the can cap has a thermally fusible adhesive layer on an inner surface thereof and a can cap welder having heating means disposed around the peripheral wall of the can cap when the can barrel is in said second position, for heating said thermally fusible adhesive layer.

4. The apparatus according to claim 1, wherein said can cap is made of a metallic material, said heating means comprising an induction heater.

5. The apparatus according to claim 1, wherein said upper edge of the can barrel includes a thermally fusible adhesive layer on the outer surface thereof; and a can cap welder having heating means disposed around the peripheral wall of the can cap when the can barrel is in said second position, for heating said thermally fusible adhesive layer.

6. An apparatus for filling an inert gas in a cap including a can cap having a panel and a peripheral wall depending from the panel along the entire periphery of the panel and a can barrel filled with contents, said apparatus comprising:

can cap holder means for holding the can cap with the panel up;

a can barrel lifting/lowering device for lifting the can barrel up to a first position in which an upper edge of the can barrel is spaced a gap from a lower edge of the peripheral wall of the can cap held by said can cap holder means, and then for lifting the can barrel up to a second position i which the upper edge of the can barrel is fitted into the peripheral wall of the can cap; and an inert gas injector having a plurality of injector nozzles along said gap for injecting an inert gas through said gap into said can cap and can barrel to replace air in said can cap and said can barrel with the injected gas, when said can barrel is in said first position, said injector nozzles include a first group of injector nozzles for injecting the inert gas into said can barrel and a second group of injector nozzles for injecting the inert gas into said can cap and said inert gas injector includes an inert gas discharge passage disposed in opposite relation to said injector nozzles for discharging an excessive inert gas injected from said injector nozzles and discharged through said can barrel and said can cap.

7. The apparatus according to claim 6, wherein the peripheral wall of the can cap has a thermally fusible adhesive layer on an inner surface thereof 1 and a can cap welder having heating means disposed around the peripheral wall of the can cap when the can barrel is in said second position, for heating said thermally fusible adhesive layer.

8. The apparatus according to claim 7, wherein said can cap is made of a metallic material, said heating means comprising an induction heater.

9. The apparatus according to claim 6, wherein said upper edge of the can barrel includes a thermally fusible adhesive layer on the outer surface thereof; and a can cap welder having heating means disposed around the peripheral wall of the can cap when the can barrel is in said second position, for heating said thermally fusible adhesive layer.

10. The apparatus according to claim 6, wherein said can cap holder means comprises a presser for resiliently holding the peripheral wall of the can cap radially inwardly, a base tubular member concentric with said presser for guiding upward movement of said can cap therein, and a vertically movable presser member slidably disposed in said base tubular member for limiting upward movement of the panel of the can cap in said base tubular member.

11. An apparatus for filling an inert gas in a cap including a can cap having a panel and a peripheral wall depending from the panel along the entire periphery of the panel and a can barrel filled with contents, said apparatus comprising:

can cap holder means for holding the can cap with the panel up;

a can barrel lifting/lowering device for lifting the can barrel up to a first position in which an upper edge of the can barrel is spaced a gap from a lower edge of the peripheral wall of the can cap held by said can cap holder means, and then for lifting the can barrel is fitted into the peripheral wall of the can cap;

an inert gas injector having a plurality of injector nozzles along said gap for injecting an inert gas through said gap into said can cap and said can barrel to replace air in said can cap and said can barrel with the injected gas, when said can barrel is in said first position;

said peripheral wall of the can cap a includes a thermally fusible adhesive layer on an inner surface thereof; and a can cap welder having heating means disposed around the peripheral wall of the can cap when the can barrel is in said second position, for heating said thermally fusible adhesive layer.

12. The apparatus according to claim 11, wherein said inert gas injector includes an inert gas discharge passage disposed in opposite relation to said injector nozzles for discharging an excessive inert gas injected from said injector nozzles and discharged through said can barrel and said can cap.

13. The apparatus according to claim 11, wherein said can cap holder means comprises a presser for resiliently holding the peripheral wall of the can cap radially inwardly, a base tubular member concentric with said presser for guiding upward movement of said can cap therein, and a vertically movable presser member slidably disposed in said base tubular member for limiting upward movement of the panel of the can cap in said base tubular member.

14. The apparatus according to claim 11, wherein said can cap is made of a metallic material, said heating means comprising an inductor heater.

15. The apparatus according to claim 11, wherein said injector nozzles include a first group of injector nozzles for injecting the inert gas into said can barrel and a second group of injector nozzles for injecting the inert gas into said can cap.

16. An apparatus for filling an inert gas in a cap including a can cap having a panel and a peripheral wall depending from the panel along the entire periphery of the panel and a can barrel filled with contents, said apparatus comprising:

can cap holder means for holding the can cap with the panel up;

a can barrel lifting/lowering device for lifting the can barrel up to a first position in which an upper edge of the can barrel is spaced a gap from a lower edge of the peripheral wall of the can cap held by said can cap holder means, and then for lifting the can barrel up to a second position in which the upper edge of the can barrel is fitted into the peripheral wall of the can cap;

an inert gas injector having a plurality of injector nozzles along said gap for injecting an inert gas through said gap into said can cap and said can barrel to replace air in said can cap and said can barrel with the injected gas, when said can barrel is in said first position;

said upper edge of the can barrel includes thermally fusible adhesive layer on the outer surface thereof; and a can cap welder having heating means disposed around the peripheral wall of the can cap when the can barrel is in said second position, for heating said thermally fusible adhesive layer.

17. The apparatus according to claim 16, wherein said inert gas injector includes an inert gas discharge passage disposed in opposite relation to said injector nozzles for discharging an excessive inert gas injected from said injector nozzles and discharged through said can barrel and said can cap.

18. The apparatus according to claim 16, wherein said can cap holder means comprises a presser for resiliently holding the peripheral wall of the can cap radially inwardly, a base tubular member concentric with said presser for guiding upward movement of said can cap therein, and a vertically movable presser member. slidably disposed in said base tubular member for limiting upward movement of the panel of the can cap in said base tubular member.

19. The apparatus according to claim 16, wherein said can cap is made of a metallic material, said heating means comprising an induction heater.

20. The apparatus according to claim 16, wherein said injector nozzles include a first group of injector nozzles for injecting the inert gas into said can barrel and a second group of injector nozzles for injecting the inert gas into said can cap.

* * * * *